US009471034B2

(12) United States Patent
Yokoi

(10) Patent No.: US 9,471,034 B2
(45) Date of Patent: Oct. 18, 2016

(54) PHOTOCONDUCTOR CARTRIDGE AND IMAGE FORMING APPARATUS

(71) Applicant: Brother Kogyo Kabushiki Kaisha, Nagoya-shi, Aichi-ken (JP)

(72) Inventor: Junichi Yokoi, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 14/755,773

(22) Filed: Jun. 30, 2015

(65) Prior Publication Data

US 2016/0004212 A1 Jan. 7, 2016

(30) Foreign Application Priority Data

Jul. 1, 2014 (JP) ..... 2014-135651

(51) Int. Cl.
*G03G 21/18* (2006.01)
*G03G 15/20* (2006.01)

(52) U.S. Cl.
CPC ..... *G03G 21/1803* (2013.01); *G03G 15/2028* (2013.01)

(58) Field of Classification Search
CPC ..... G03G 15/2028; G03G 15/657; G03G 21/1633
USPC ..... 399/400
See application file for complete search history.

(56) References Cited

U.S. PATENT DOCUMENTS 4,470,689 A * 9/1984 Nomura ..... G03G 15/75 355/71
6,101,351 A 8/2000 Suda et al.
2006/0182479 A1* 8/2006 Miyake ..... G03G 15/657 399/400
2009/0074452 A1* 3/2009 Noda ..... F16D 1/101 399/111
2009/0152791 A1* 6/2009 Igarashi ..... G03G 21/1853 271/4.08
2012/0251156 A1* 10/2012 Hirose ..... G03G 15/657 399/92
2014/0064779 A1 3/2014 Sato

FOREIGN PATENT DOCUMENTS

JP H11-338212 A 12/1999
JP 2004-053865 A 2/2004
JP 2007156166 A * 6/2007
JP 2008-070745 A 3/2008
JP 2013-234011 A 11/2013
JP 2014-048314 A 3/2014

* cited by examiner

*Primary Examiner* — David Gray
*Assistant Examiner* — Sevan A Aydin
(74) *Attorney, Agent, or Firm* — Banner & Witcoff, Ltd.

(57) ABSTRACT

In an image forming apparatus, a photoconductor cartridge including a photoconductor is removably installed in a housing, a transfer unit configured to transfer a developer image onto a sheet in a transfer position is disposed in contact with the photoconductor, a developer cartridge is removably installed in the housing, and a fixing unit is configured to fix a developer image on the sheet in a fixing position. The housing has a first opening provided behind the transfer unit opposite to the photoconductor, and a second opening provided separate from the first opening. The photoconductor cartridge can be removed from and installed into the housing through the to first opening. The developer cartridge can be removed from and installed into the housing through the second opening. The photoconductor cartridge includes a chute that extends between the transfer position and the fixing unit to guide the sheet toward the fixing unit.

13 Claims, 4 Drawing Sheets

PHOTOCONDUCTOR CARTRIDGE AND IMAGE FORMING APPARATUS

CROSS-REFERENCE TO RELATED APPLICATION(S)

This application claims priority from Japanese Patent Application No. 2014-135651 filed on Jul. 1, 2014, the disclosure of which is incorporated herein by reference in its entirety.

TECHNICAL FIELD

Apparatuses disclosed herein relate to a photoconductor cartridge detachably attached to a housing and an image forming apparatus including such a photoconductor cartridge.

BACKGROUND ART

An image forming apparatus known in the art typically comprises a photoconductor cartridge, a transfer unit, and a fixing unit (fuser assembly). The photoconductor cartridge includes a photoconductor. The transfer unit is in contact with the photoconductor. In the image forming apparatus, a sheet is nipped between the photoconductor and the transfer unit and passed therethrough, and then forwarded into the fixing unit. The photoconductor cartridge is configured to be installable in, and removable from, the housing of the image forming apparatus, through an opening formed at a rear side of the housing.

In order to achieve a stable conveyance of a sheet into the fixing unit, a chute may be provided to guide the sheet being conveyed from the photoconductor toward the fixing unit. The accurate position of the chute relative to the sheet being conveyed toward the fixing unit is critical because improperly positioned chute would undermine the stability of conveyance of the sheet into the fixing unit.

SUMMARY

In one aspect, an image forming apparatus is provided in which a sheet nipped between a photoconductor and a transfer unit, and passed therethrough can be conveyed toward a fixing unit in a stable manner.

More specifically, according to one or more of embodiments, an image forming apparatus comprises a housing, a photoconductor cartridge, a transfer unit, a developer cartridge, and a fixing unit. The photoconductor cartridge includes a photoconductor configured to carry a developer image. The photoconductor cartridge is removably installed in the housing. The transfer unit is disposed in contact with the photoconductor. The transfer unit is configured to transfer the developer image from the photoconductor onto a sheet in a transfer position. The developer cartridge is configured to store developer to be supplied to the photoconductor. The developer cartridge is removably installed in the housing. The fixing unit is configured to fix the developer image on the sheet in a fixing position. The housing has a first opening and a second opening. The first opening is provided behind the transfer unit opposite to the photoconductor to allow the photoconductor cartridge to be removed from and installed into the housing through the first opening. The second opening is provided separate from the first opening to allow the developer cartridge to be removed from and installed into the housing through the second opening. The photoconductor cartridge includes a chute that extends between the transfer to position and the fixing unit to guide the sheet toward the fixing unit.

In another aspect, a photoconductor cartridge is provided which comprises a photoconductor, a transfer unit and a chute. The transfer unit is disposed in contact with the photoconductor. The transfer unit is configured to transfer a developer image onto a sheet in a transfer position. The chute extends downstream in a sheet conveyance direction to guide the sheet conveyed from the transfer position. The chute has a downstream end facing downstream in the sheet conveyance direction, and the chute includes a first comb-like portion provided at the downstream end.

BRIEF DESCRIPTION OF THE DRAWINGS

The above and other aspects, their advantages and further features will become more apparent by describing in detail illustrative, non-limiting embodiments thereof with reference to the accompanying drawings, in which.

DESCRIPTION OF EMBODIMENTS

Figure 1:
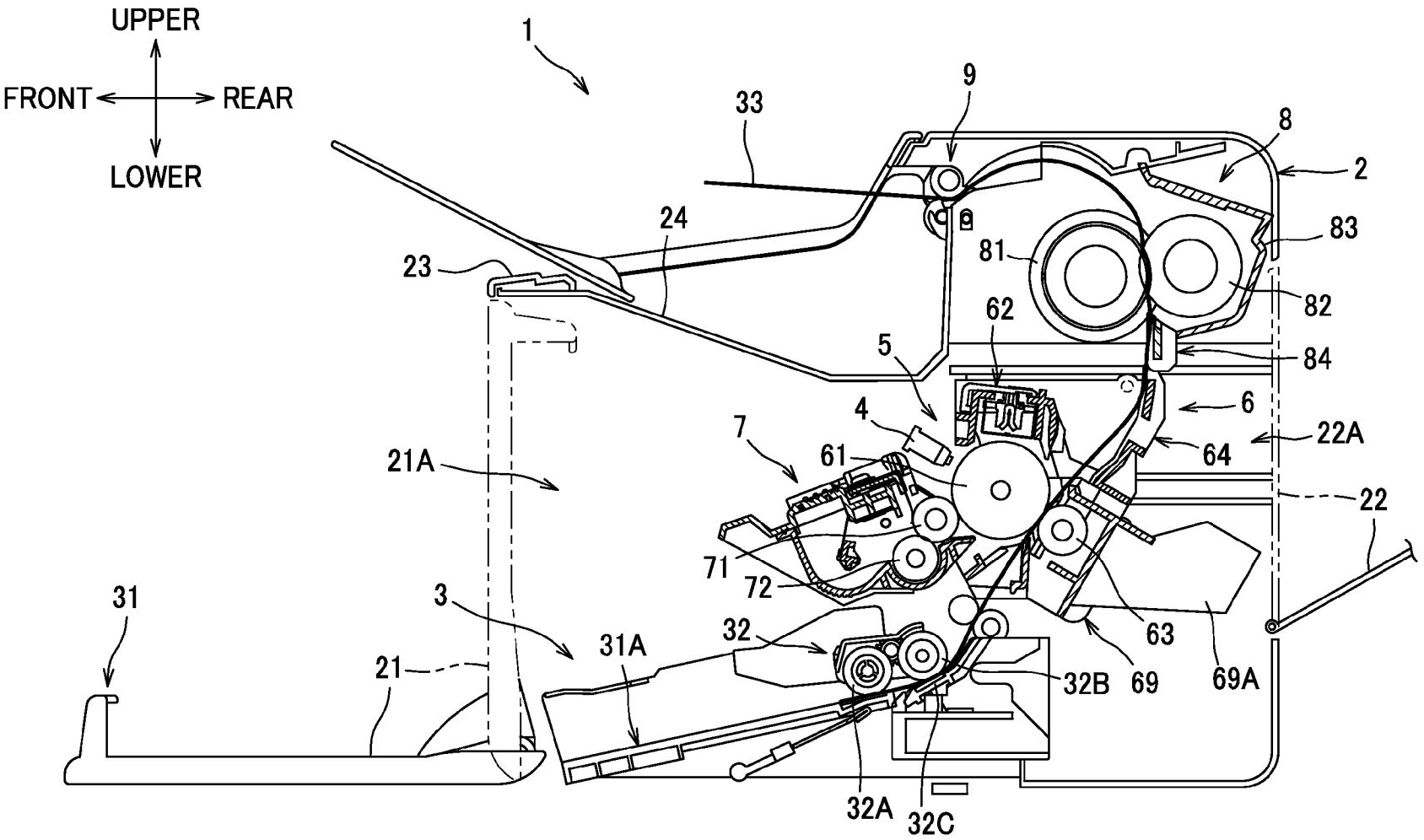
FIG. 1 is a sectional view of a laser printer according to one illustrative embodiment.

A detailed description will be given of illustrative, non-limiting embodiments with reference made to the drawings where appropriate. In the following description, a general setup of a laser printer 1 will be described at the outset, and specific configurations of a photoconductor cartridge and associated structures will be described in detail.

In the following description, the direction is designated as in FIG. 1; the left-hand side of the drawing sheet corresponds to the "front" side of the printer, the right-hand side of the drawing sheet corresponds to the "rear" side of the printer, the back side of the drawing sheet corresponds to the "left" side of the printer, and the front side of the drawing sheet corresponds to the "right" side of the printer. The upper/lower (top/bottom) sides of the drawing sheet corresponds to the "upper/under or top/bottom" sides of the printer, and the direction of a line extending upward and/or downward is referred to as "upward-downward direction".

As shown in FIG. 1, the laser printer 1 mainly includes a housing 2, a feeder unit 3, an to LED unit 4, a process unit 5, and a fixing unit 8.

The housing 2 is provided with a front cover 21 and a rear cover 22. The front cover 21 and the rear cover 22 are configured to be swingable with respect to the housing 2. The housing 2 has a front opening 21A and a rear opening 22A. The front opening 21A is a through hole provided at a front side of the housing 2, and the rear opening 22A is a through hole provided at a rear side of the housing 2. The front cover 21 is disposed to cover and close the front opening 21A and can be swung open; thus, the front opening 21A is openably closable by the front cover 21. The rear cover 22 is disposed to cover and close the rear opening 22A and can be swung open; thus, the rear opening 22A is openably closable by the rear cover 22. The front opening 21A is an example of a second opening, and the rear opening 22A is an example of a first opening. Through the front opening 21A, sheets (e.g., of paper) can be set in the housing 2. A display unit 23 configured to display an operation status of the laser printer 1 is disposed on an upper surface on a front side of the housing 2.

The feeder unit 3 is located in a lower space inside the housing 2, and includes a sheet feed tray 31 on which sheets 33 can be placed, and a sheet feed mechanism 32 configured to feed a sheet 33 on the sheet feed tray 31.

The sheet feed tray 31 is configured to include a rack 31A disposed in a lower space within the housing 2, and the front cover 21 described above. The sheet feed mechanism 32 mainly includes a sheet feed roller 32A, a separation roller 32B, and a separation pad 32C.

In the feeder unit 3, sheets 33 placed on the sheet feed tray 31 are fed by the sheet feed roller 32A and separated one sheet from others between the separation roller 32B and the separation pad 32C, and conveyed toward the process unit 5.

The LED unit 4, which is an example of an exposure unit, is provided in the housing 2 and disposed opposite to a peripheral surface of a photoconductor drum 61 as an example of a photoconductor which will be described later. The LED unit 4 includes a plurality of light-emitting elements (not shown) arranged in a lateral direction (in an axial direction of the photoconductor drum 61).

The process unit 5 is located in a rear-side space (substantially at the center thereof) within the housing 2, and provided above the sheet feed mechanism 32. The process unit 5 includes a photoconductor cartridge 6, a development cartridge 7 as an example of a developer cartridge.

The photoconductor cartridge 6 is configured to be removable from and installable in the housing 2 through the rear opening 22A, and includes a photoconductor drum 61, a charger 62, to and a transfer roller 63 as an example of a transfer unit. The development cartridge 7 is configured to be removable from and installable in the housing 2 through the front opening 21A, and includes a development roller 71 and a supply roller 72.

In the development cartridge 7, toner as an example of developer stored in a toner storage chamber is supplied to the development roller 71, and frictionally electrified, by the supply roller 72, and carried on the development roller 71. In the photoconductor cartridge 6, the peripheral surface of the rotating photoconductor drum 61 is uniformly charged by the charger 62 and then exposed to light by the LED unit 4. In this way, an electrostatic latent image formulated based upon image data is formed on the peripheral surface of the photoconductor drum 61.

Subsequently, this electrostatic latent image is supplied with toner carried on the development roller 71, and a toner image is formed on the peripheral surface of the photoconductor drum 61. Thereafter, a sheet 33 is conveyed through between the photoconductor drum 61 and the transfer roller 63, so that the toner image carried on the peripheral surface of the photoconductor drum 61 is transferred onto the sheet 33.

The fixing unit 8 is disposed above the photoconductor cartridge 6. The fixing unit 8 mainly includes a heating roller 81 and a pressure roller 82.

The fixing unit 8 is configured to thermally fix toner transferred on the sheet 33 while the sheet 33 is forwarded through between the heating roller 81 and the pressure roller 82. The sheet 33 with toner thermally fixed thereon is conveyed to an ejection roller 9 disposed downstream of the fixing unit 8, and ejected from this ejection roller 9 onto a sheet output tray 24.

Next, the structures and arrangement of and around the photoconductor cartridge 6 and the fixing unit 8 will be described in detail. The photoconductor cartridge 6 includes a photoconductor frame 69, as an example of a frame, which is configured to support the photoconductor drum 61, charger 62 and transfer roller 63 described above.

The photoconductor drum 61 has a peripheral surface of which substantially half is exposed through the photoconductor frame 69. This exposed region of the peripheral surface of the photoconductor drum 61 is opposed to the LED unit 4 and the development roller 71. The LED unit 4 is disposed behind the photoconductor drum 61 opposite to the rear opening 22A (i.e., the LED unit 4 and the rear opening 22A are disposed on opposite sides with the photoconductor drum 61 between), and the development roller 71 is disposed behind the photoconductor drum 61 opposite to the fixing unit 8 (i.e. the development roller 71 and the fixing unit 8 are disposed on opposite sides with the photoconductor drum 61 between).

The charger 62 is disposed above the photoconductor drum 61, that is, on a fixing-unit side that is one of opposite sides with respect to the photoconductor 61 on which the fixing unit 8 is disposed. The transfer roller 63 is provided in a rear space within the photoconductor frame 69, and in contact with the peripheral surface of the photoconductor drum 61 at an obliquely-rear-and-lower side of the photoconductor drum 61. The rear opening 22A described above is disposed behind the transfer roller 63 opposite to the photoconductor drum 61 (i.e., the rear opening 22A and the photoconductor drum 61 are on opposite sides with the transfer roller 63 between).

Figure 3:
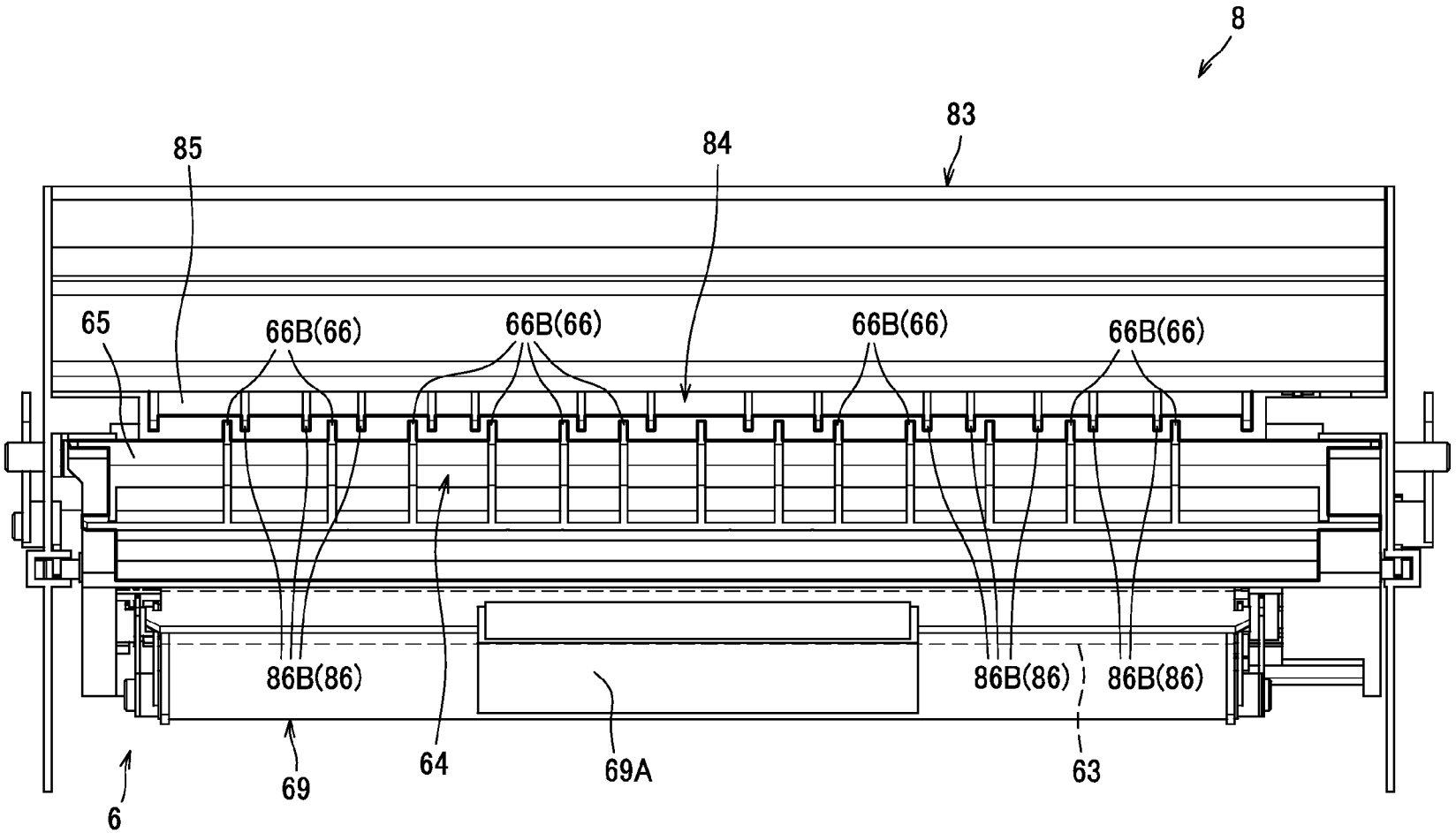
FIG. 3 is a rear view illustrating the photoconductor cartridge and the fixing unit.

A handle 69A is provided at a rear side of the photoconductor frame 69 to provide a grip to be held or grasped by a user when the photoconductor cartridge 6 is carried or manipulated. The handle 69A extends rearward from the photoconductor frame 69, and is disposed, as shown in FIG. 3, in such a position that the handle 69A overlaps the transfer roller 63 as viewed from the rear side.

Figure 2:
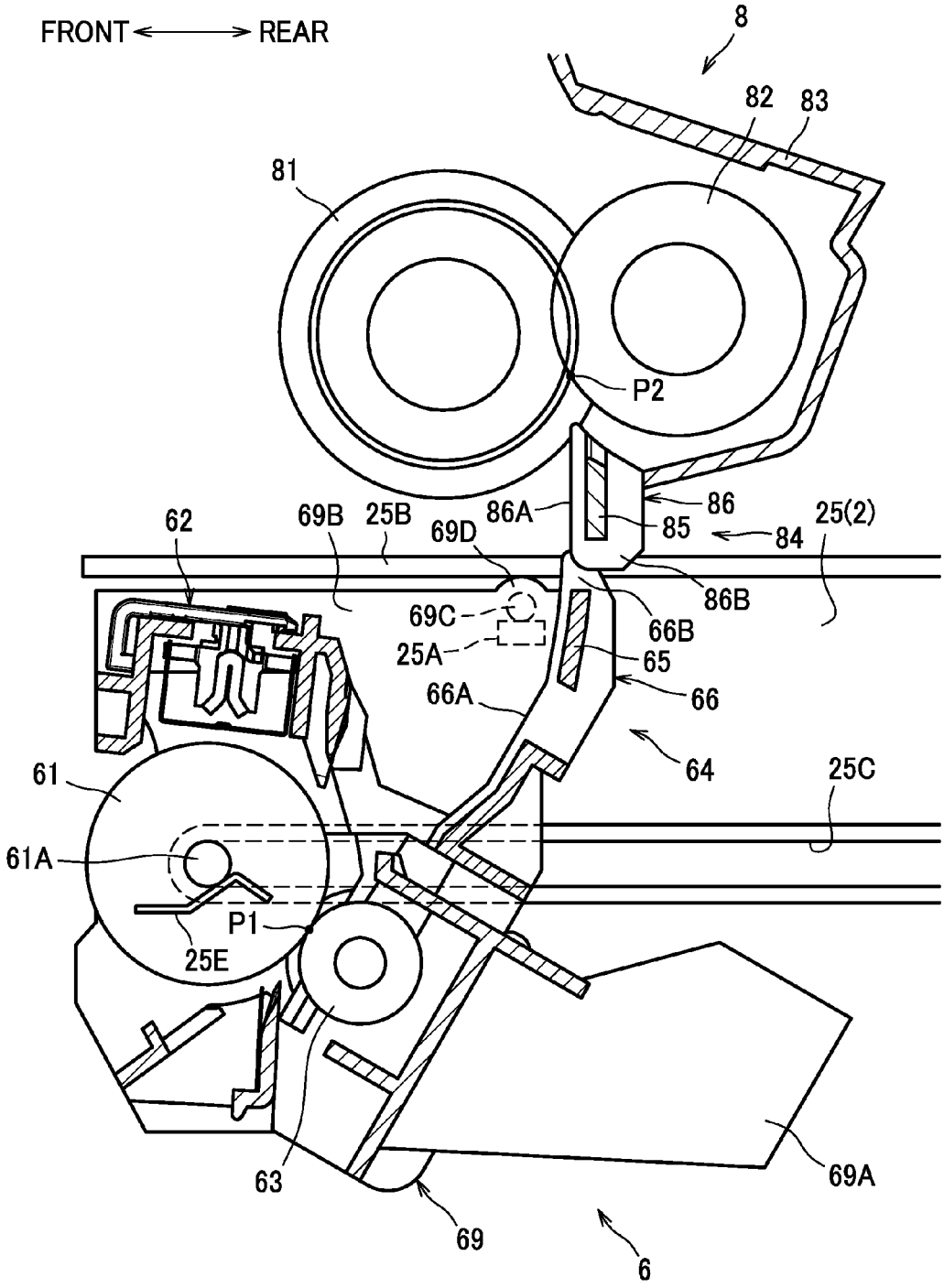
FIG. 2 is an enlarged view illustrating a photoconductor cartridge and a fixing unit in FIG. 1.

As shown in FIG. 2, the photoconductor frame 69 includes left and right sidewalls 69B, and a first contact portion 69C as an example of a first engageable portion is provided at each of the sidewalls 69B. A left first contact portion 69C protrudes from the left sidewall 69B outward (to the left) while a right first contact portion 69C protrudes from the right sidewall 69B outward (to the right). Each first contact portion 69C is disposed at a position in an upper end portion of the corresponding sidewall 69B, opposite, separately, to an obliquely-rear-and-upper side of the photoconductor drum 61 (i.e., on the fixing-unit side that is one of opposite sides with respect to the photoconductor 61 on which the fixing unit 8 is disposed). Provided at an upper end of each sidewall 69B is a second contact portion 69D protruding upward. The second contact portion 69D is disposed in a position corresponding to the first contact portion 69C in the front-rear direction.

The housing 2 includes left and right side frames 25, and a first housing-side contact portion 25A as an example of a second engageable portion and a second housing-side contact portion 25B are provided at each of the side frames 25. The first housing-side contact portion 25A is contactable with a lower end of the corresponding first contact portion 69C. The second housing-side contact portion 25B is contactable with an upper end of the corresponding second contact portion 69D. A left first housing-side contact portion 25A protrudes from the left side frame 25 inward (to the right) while a right first housing-side contact portion 25A protrudes from the right side frame 25 inward (to the left). A left second housing-side contact portion 25B protrudes from the left side frame 25 inward (to the right) while a right second housing-side contact portion 25B protrudes from the right side frame 25 inward (to the left).

A guide portion 25C is provided at each side frame 25. The guide portion 25C is configured to guide installation and removal of the photoconductor cartridge 6. The guide portion 25C is configured as a groove engageable with a drum shaft 61A of the photoconductor drum 61 and shaped to extend in the front-rear direction. The side frame 25 is also provided with a spring 25E to lock the drum shaft 61A.

The photoconductor cartridge 6 includes a first chute 64 as an example of a chute configured to guide a sheet 33 passed through between the photoconductor drum 61 and the transfer roller 63 toward the fixing unit 8. The first chute 64 extends, from a position in the photoconductor frame 69 corresponding to a transfer position P1 in which the photoconductor drum 61 and the transfer roller 63 are in contact with each other, toward the fixing unit 8 (downstream in a sheet 33 conveyance direction).

As shown in FIG. 1, the aforementioned rear opening 22A is disposed right behind the first chute 64. In other words, the rear opening 22A is disposed behind the first chute 64 opposite to a path of a sheet being conveyed toward the fixing unit 8 (i.e., the rear opening 22A and the path of the sheet being conveyed toward the fixing unit 8 are disposed on opposite sides with the first chute 64 between).

As shown in FIGS. 2 and 3, the first chute 64 includes a plurality of first chute main units 66 arranged laterally, and a first connecting portion 65 extending laterally and connecting the plurality of first chute main units 66.

The first chute main units 66 are units each shaped like a rib protruding from the front surface and the rear surface of the first connecting portion 65 and arranged along the path of a sheet 33 being conveyed from the transfer position P1 toward the fixing unit 8 (in a sheet conveyance direction). Each of the first chute main units 66 has a front-side surface 66A that is an end face of a portion protruding from the front surface of the first connecting portion 65. The front-side surface 66A is contactable with a sheet 33 being conveyed from the transfer position P1.

The front-side surface 66A is an example of an inwardly curved surface, and is recessed rearward. The front-side surface 66A is so arranged that the inwardly curved surface faces the path of a sheet 33 being conveyed from the transfer position P1 toward the fixing unit 8.

Each of the first chute main units 66 includes an upper end portion 66B protruding from an upper end of the first connecting portion 65. Upper end portions 66B and the upper end of the first connecting portion 65 of the first chute 64 are shaped like a comb, as viewed from the rear; thus, the first chute 64 has a comb-tooth shape formed in a distal (upper) end portion thereof (at a to fixing-side end thereof facing to the fixing unit 8, or at a downstream end facing downstream in the sheet conveyance direction). These upper end portions 66B and the upper end of the first connecting portion 65 form a first comb-like portion configured by way of example.

The fixing unit 8 includes a fixing unit frame 83 by which the heating roller 81 and the pressure roller 82 described above are supported. The fixing unit frame 83 is provided with a second chute 84. The second chute 84 extends from a lower end portion of the fixing unit frame 83 toward the photoconductor cartridge 6.

The second chute 84 is configured to further guide a sheet 33 guided by the first chute 64, to a fixing position P2 in which the heating roller 81 and the pressure roller 82 are in contact with each other. The second chute 84 includes a plurality of second chute main units 86 arranged laterally, and a second connecting portion 85 extending laterally and connecting the plurality of second chute main units 86.

The second chute main units 86 are units each shaped like a rib protruding from the front surface and the rear surface of the second connecting portion 85 and arranged along the path of a sheet 33 being conveyed from the transfer position P1 toward the fixing unit 8 (in the sheet conveyance direction). Each of the second chute main units 86 has a front-side surface 86A that is an end face of a portion protruding from the front surface of the second connecting portion 85. The front-side surface 86A is contactable with a sheet 33 being conveyed toward the fixing position P2.

Each of the second chute main units 86 includes a lower end portion 86B protruding from a lower end of the second connecting portion 85. Lower end portions 86B and the lower end of the second connecting portion 85 of the second chute 84 are shaped like a comb, as viewed from the rear; thus, the second chute 84 has a comb-tooth shape formed in a distal (lower) end portion thereof (at a photoconductor-side end facing the photoconductor cartridge 6). These lower end portions 86B and the lower end of the second connecting portion 85 form a second comb-like portion configured by way of example.

As shown in FIG. 2, the upper end portions 66B of the first chute main units 66 and the lower end portions 86B of the second chute main units 86 are overlap each other as viewed in a lateral direction (in an axial direction of the photoconductor drum 61). In other words, the first chute 64 and the second chute 84 are arranged so as not to make a gap in the sheet conveyance direction. As shown in FIG. 3, the upper end portions 66B of the first chute main units 66 and the lower end portions 86B of the second chute main units 86 are arranged in positions shifted from each other.

The upper end portions 66B of the first chute main units 66 are located frontwardly of (i.e., closer to the sheet 33 being conveyed than) the lower end portions 86B of the second chute main units 86. This may serve to prevent the sheet 33 being conveyed from the transfer position P1, from colliding with the lower ends of the second chute main units 86.

Operation of the laser printer 1 configured as described above will now be described.

As shown in FIG. 2, a sheet 33 passed through the transfer position P1 is conveyed toward the fixing unit 8. The sheet 33 is guided by the first chute 64, and thus conveyed stably toward the fixing unit 8. The sheet 33 is conveyed while smoothly sliding in contact with the curved front-side surface 66A of the first chute 64.

As no gap is left between the first chute 64 and the second chute 84 in the sheet conveyance direction, the sheet 33 is smoothly conveyed from the first chute 64 to the second chute 84. The sheet is guided by the second chute 84 and conveyed toward the fixing position P2. Accordingly, the sheet 33 is stably conveyed from the transfer position P1 toward the fixing position P2.

On the other hand, when the development cartridge 7 is removed from the housing 2, the front cover 21 is swung open and the development cartridge 7 is removed through the front opening 21A. In this operation, the development cartridge 7 is removed from a display-unit side of the housing 2 on which the display unit 23 is provided to display an operation status of the laser printer 7 for a user, that is, from a front side (i.e., from a user side), the replacement of the development cartridge 7 that may be required more frequently than the replacement of the photoconductor cartridge 6 can be carried out more easily.

When the photoconductor cartridge 6 is removed from the housing 2, the rear cover 22 is swung open and the photoconductor cartridge 6 is removed through the rear opening 22A. In this operation, the drum shaft 61A is moved straight rearward along the guide portion 25C until the photoconductor cartridge 6 is removed out of the housing 2. Since the first chute main units 66 and the second chute main units 86 are arranged alternately in positions laterally shifted from each other, the photoconductor cartridge 6 can be removed smoothly without interference with the second chute 84. Since the handle 69A is configured to extend rearward, the user can easily grasp and manipulate the photoconductor cartridge 6 inside the housing 2.

Since the LED unit 4 is opposite to the front side of the peripheral surface of the photoconductor drum 61, the light-emitting elements of the LED unit 4 that face rearward can be easily accessed for cleaning once the photoconductor cartridge 6 is removed through the rear opening 22A.

In this configuration described above, the development cartridge 7 and the photoconductor cartridge 6 are removed from different sides, respectively, each cartridge 7, 6 can be removed from the housing 2 smoothly without interfering with other components inside the housing 2, more smoothly in comparison with an alternative configuration in which the development cartridge 6 and the photoconductor cartridge are removed from one and the same side. Further, the photoconductor cartridge 6 is removed through the rear opening 22A, the photoconductor cartridge can be removed smoothly without interfering with the LED unit 4 that is disposed at the front side of the photoconductor drum 61 (i.e., behind the photoconductor drum 61 opposite to the rear opening 22A).

When the development cartridge 7 and the photoconductor cartridge 6 are installed in the housing 2, the development cartridge 7 is installed through the front opening 21A and the photoconductor cartridge 6 is installed through the rear opening 22A.

In this operation, the drum shaft 61A of the photoconductor cartridge 6 is moved frontward along the guide portion 25C, until the drum shaft 61A is locked by the spring 25E at the frontmost position of the guide portion 25C. Then, the first contact portion 69C of the photoconductor cartridge 6 is engaged with the first housing-side contact portion 25A of the side frame 25. In this way, the photoconductor cartridge 6 is installed in the housing 2. Accordingly, the vertical position of the photoconductor cartridge 6 is determined, so that the first chute 64 is accurately positioned relative to the fixing position P2 of the fixing unit 8.

With this configuration, even when the photoconductor cartridge 6 installed in the housing 2 receives a rotational force produced in a counterclockwise direction in FIG. 2 about the drum shaft 61A according to the rotation of the photoconductor drum 61, the second contact portion 69D of the photoconductor cartridge 6 getting in contact with the second housing-side contact portion 25B of the side frame 25 serves to restrict the rotation of the photoconductor cartridge 6 about the drum shaft 61A, making the photoconductor cartridge 6 stable in place.

In this installation operation, as well as the removal operation, the development cartridge 7 and the photoconductor cartridge 6 can be installed smoothly in the housing 2, respectively, without interfering with any other components inside the housing 2.

Advantages of the configuration described above are as follows:

Since the accurate positioning of the first chute 64 relative to the photoconductor drum 61 and the transfer roller 65 can be established with increased ease, a sheet 33 passed through between the photoconductor drum 61 and the transfer roller 63 can be conveyed stably toward the fixing device 8.

Since the photoconductor cartridge 6 can be removed through the rear opening 22A provided right behind the first chute 64 (behind the first chute 64 opposite to the path of a sheet 33 being conveyed toward the fixing unit 8), a user can remove the photoconductor cartridge 6 from the housing 2 with increased ease.

Since the first chute 64 has an inwardly curved front-side surface 66A facing the path of a sheet 33 being conveyed toward the fixing unit 8, the sheet 33 with a toner image formed thereon can be guided smoothly while letting its back side slide on the front-side surface 66A.

Since the first chute 64 and the second chute 84 are provided, the sheet 33 can be guided properly from the transfer position P1 toward the fixing position P2.

Since no gap is left in the sheet conveyance direction between the first chute 64 and the second chute 84, the sheet 33 can be conveyed smoothly.

Since the fixing unit 8 is disposed above the photoconductor cartridge 6, the heat produced in the fixing unit 8 is less likely to affect the photoconductor drum 61. Similarly, since the development roller 71 is disposed behind the photoconductor drum 61 opposite to the fixing unit 8, the development roller 71 is less likely to receive an adverse effect of the heat produced in the fixing unit 8.

Since the charger 62 is included in the photoconductor cartridge 6 and supported by the photoconductor frame 69, the charger 62 can be easily handled for replacement or cleaning outside the housing 2 by a user taking out the photoconductor cartridge 6.

Since the vertical position of the photoconductor cartridge 6 as installed in the housing 2 can be determined appropriately by the first contact portion 69C of the photoconductor cartridge 6 engaged with the first housing-side contact portion 25A of the side frame 25, the first chute 64 and the fixing unit 8 are accurately positioned relative to each other.

Since the transfer unit 63 is supported by the photoconductor cartridge 69, the accuracy of the transfer process can be improved in comparison with an alternative configuration in which a transfer roller (transfer unit) is provided in a housing of the printer.

Since the transfer roller 63 is so disposed as to overlap the handle 69A as viewed from the rear side, the transfer roller 63 can be protected from the handle 69A. Furthermore, since the handle 69A of the photoconductor cartridge 6 is disposed behind the transfer roller 63 opposite to the photoconductor drum 61 (i.e., the handle 69A and the photoconductor drum 61 are disposed on opposite sides with the transfer roller 63 between), the photoconductor cartridge 6 can be removed easily through the rear opening 22A by the use of the handle 69A.

Installation and removal of the development cartridge 7 are carried out at the front side, that is, through the front opening 21A at the same side as the side on which the display unit 23 faces a user. Therefore, the installation and removal of the development cartridge 7 which are required more frequently than those of the photoconductor cartridge 6 can be made easy.

Since the LED unit 4 is disposed at the front side of the photoconductor drum 61, cleaning of the LED unit 4 can be conducted easily when the photoconductor cartridge 6 is removed through the rear opening 22A. Moreover, interference of the photoconductor cartridge 6 with the LED unit 4 upon installation and removal of the photoconductor cartridge 6 is less likely to occur in comparison with an alternative configuration in which the photoconductor cartridge and the development cartridge are removed and installed through the front opening.

It is to be understood that various modifications and changes may be made to the above-described specific embodiment as will be described below by way of example.

Figure 4:
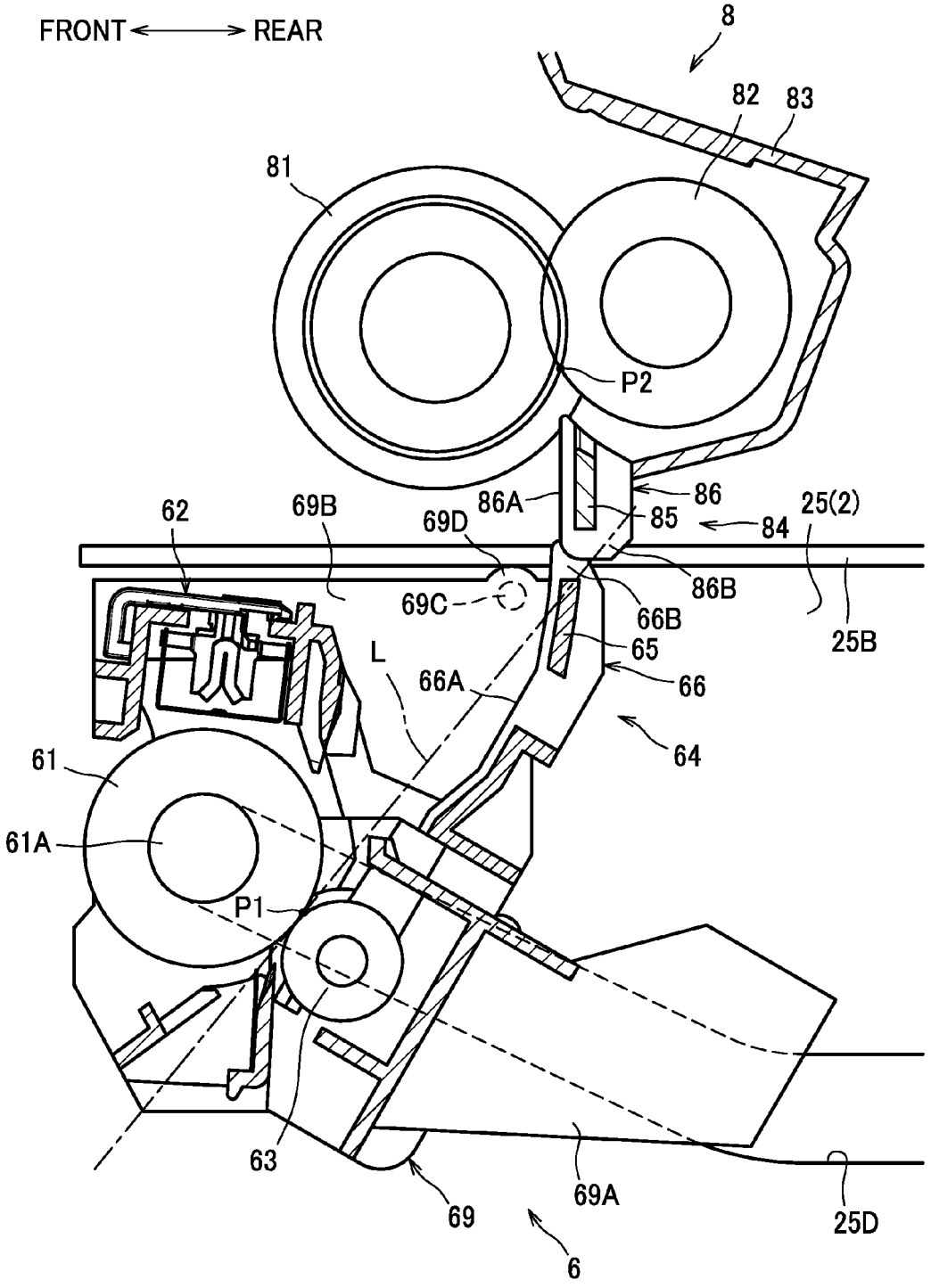
FIG. 4 is an enlarged view illustrating a photoconductor cartridge and a fixing unit configured according to a modified example.

In the above description, the guide portion 25C is illustrated as extending in the front-rear direction, but an alternative configuration may be feasible; for example, as shown in FIG. 4, a guide portion 25D may be shaped to deviate toward the fixing unit 8 in a direction from the outside of the housing 2 into the housing 2.

With this alternative configuration, since the photoconductor 6 is moved away from the fixing unit 8 according as the photoconductor cartridge 6 is moved toward the outside of the housing 2, interference of the first chute 64 with the fixing unit 8 which would occur when the photoconductor cartridge 6 is removed and installed can be prevented.

Since the charger 62 is disposed over the photoconductor drum 61 (i.e., on a fixing-unit side that is one of opposite sides with respect to the photoconductor drum 61 on which the fixing unit 8 is disposed) in the photoconductor cartridge 6, interference of the charger 62 with the fixing unit 8 would likely occur when the photoconductor cartridge 6 is removed and installed; however, this alternative configuration illustrated in FIG. 4 is configured such that the guide portion 25D causes the photoconductor cartridge 6 to be moved away from the fixing unit 8 when the photoconductor cartridge 6 is removed, and thus interference of the charge 62 with the fixing unit 8 which would occur when the photoconductor cartridge 6 is removed and installed can be suppressed.

Also, in this configuration, the first chute 64 is disposed in such a position that the tangent to the photoconductor drum 61 at the transfer position P1 intersects the first chute 64. Accordingly, the sheet 33 passed through the transfer position P1 becomes likely to get in contact with the first chute 64, so that the guiding of the sheet 33 by the first chute 64 toward the fixing unit 8 can be facilitated.

In the above description, the curved first chute 64 is illustrated by way of example; however, the curved surface is not requisite. The first chute may not be curved.

In the above description, the first chute 64 and the second chute 84 illustrated by way of example are both configured to include comb-like portions (shaped like combs) at their distal ends; however, such comb-like shape in the distal-end portion is not requisite. The comb-like shape may not be provided in either or both of the first and second chutes 64, 84.

In the above description, the first contact portion 69C as an example of the first engageable portion is provided by way of example; however, this is not requisite. Such an engageable portion may not be provided.

In the above description, the transfer roller 63 is illustrated, by way of example, as being supported by the photoconductor frame 69; however, the transfer roller 63 may be supported by any other portion, for example, by the rear cover 22.

In the above description, the development cartridge 7 is adopted as an example of a developer cartridge; however, a toner cartridge storing toner can be adopted as an alternative of the development cartridge 7. In this configuration, the development roller and the supply roller may be provided in the photoconductor cartridge.

In the above description, a monochrome laser printer 1 is illustrated as an example of an image forming apparatus, but a color printer or a multifunction peripheral, or other type of image forming apparatus may be configured as described herein.

What is claimed is:

1. An image forming apparatus comprising:

a housing;

a photoconductor cartridge configured to be removably installed in the housing in a first direction, the photoconductor cartridge including a photoconductor and a transfer unit, the photoconductor being configured to carry a developer image, the transfer unit being disposed in contact with the photoconductor, the transfer unit being configured to transfer the developer image onto a sheet in a transfer position;

a developer cartridge configured to be removably installed in the housing, the developer cartridge being configured to store developer to be supplied to the photoconductor, the developer cartridge including a development roller configured to supply toner to the photoconductor;

a fixing unit configured to fix the developer image on the sheet in a fixing position; and a feeder unit configured to convey a sheet toward the transfer position, the feeder unit being disposed below the photoconductor cartridge and the developer cartridge, the feeder unit and the fixing unit being disposed on opposite sides of a horizontal plane passing through the photoconductor, wherein the housing has a first opening and a second opening, the first opening and the photoconductor being disposed on opposite sides of a vertical plane perpendicular to the first direction and passing through the transfer unit to allow the photoconductor cartridge to be removed from and installed into the housing in the first direction through the first opening, the second opening being provided separate from the first opening to allow the developer cartridge to be removed from and installed into the housing through the second opening, and wherein the photoconductor cartridge includes a chute that extends between the transfer position and the fixing unit to guide the sheet toward the fixing unit.

2. The image forming apparatus according to claim 1, wherein the first opening and the photoconductor are disposed on opposite sides of a vertical plane perpendicular to the first direction and passing through the chute.

3. The image forming apparatus according to claim 1, wherein the chute has an inwardly curved surface facing a path of a sheet being conveyed toward the fixing unit.

4. The image forming apparatus according to claim 3, wherein a tangent to the photoconductor at the transfer position intersects the chute.

5. The image forming apparatus according to claim 1, wherein the fixing unit includes a second chute that extends toward the photoconductor cartridge to guide the sheet from the chute to the fixing position.

6. The image forming apparatus according to claim 5, wherein the chute has a fixing-side end facing to the fixing unit, the chute including a first comb-shaped portion provided at the fixing-side end, wherein the second chute has a photoconductor-side end facing to the photoconductor cartridge, the second chute including a second comb-shaped portion provided at the photoconductor-side end, and wherein the first comb-shaped portion and the second comb-shaped portion overlap each other in an axial direction of the photoconductor.

7. The image forming apparatus according to claim 5, wherein the chute includes a plurality of first chute main units arranged in an axial direction of the photoconductor, and a first connecting portion connecting the plurality of the first chute main units, each of the plurality of first chute main units protruding toward the fixing unit from the first connecting portion, the plurality of first chute main units each having a fixing-side end facing to the fixing unit, the first connecting portion having a fixing-side end facing to the fixing unit, the fixing-side ends of the first chute main units being disposed closer to the fixing unit than the fixing-side end of the first connecting portion to provide a first comb-shaped portion, wherein the second chute includes a plurality of second chute main units arranged in an axial direction of the photoconductor, and a second connecting portion connecting the plurality of the second chute main units, each of the plurality of second chute main units protruding toward the photoconductor cartridge from the second connecting portion, the plurality of second chute main units each having a photoconductor-side end facing to the photoconductor cartridge, the second connecting portion having a photoconductor-side end facing to the photoconductor cartridge, the photoconductor-side ends of the second chute main units being disposed closer to the photoconductor cartridge than the photoconductor-side end of the second connecting portion to provide a second comb-shaped portion, and wherein the first comb-shaped portion and the second comb-shaped portion overlap each other in the axial direction of the photoconductor.

8. The image forming apparatus according to claim 1, wherein the housing includes a guide portion configured to guide installation and removal of the photoconductor cartridge, the guide portion being shaped to deviate toward the fixing unit in a direction from outside of the housing into the housing.

9. The image forming apparatus according to claim 8, wherein the photoconductor cartridge further includes a charger disposed on a fixing-unit side that is one of opposite sides of the horizontal plane passing through the photoconductor on which the fixing unit is disposed.

10. The image forming apparatus according to claim 1, wherein the photoconductor cartridge further includes a first engageable portion separate from the photoconductor toward the fixing unit, and wherein the housing includes a second engageable portion that is engageable with the first engageable portion.

11. The image forming apparatus according to claim 1, further comprising a cover configured to openably close the first opening, wherein the photoconductor cartridge includes a handle, the photoconductor and the handle being disposed on opposite sides of a vertical plane perpendicular to the first direction and passing through the transfer unit, and wherein a distance between the handle and the cover is shorter than a distance between the chute and the cover.

12. The image forming apparatus according to claim 1, further comprising a display unit configured to display an operation status of the image forming apparatus, wherein the second opening is disposed at a side of the housing on a display-unit side of the housing on which the display unit is provided.

13. The image forming apparatus according to claim 1, further comprising an exposure unit facing a peripheral surface of the photoconductor, the exposure unit including a plurality of light-emitting elements arranged in an axial direction of the photoconductor, the exposure unit being disposed above the developer cartridge.

* * * * *